United States Patent [19]

Sparling

[11] 3,972,355

[45] Aug. 3, 1976

[54] WEFT INSERTING DRIVING MEANS FOR A SHUTTLELESS LOOM

[75] Inventor: Robert O. Sparling, Smithfield, R.I.

[73] Assignee: Cox Foundry & Machine Company, Atlanta, Ga.

[22] Filed: June 13, 1975

[21] Appl. No.: 586,735

[52] U.S. Cl. ..... 139/449; 192/67 R

[51] Int. Cl.[2] ..... D03D 47/00

[58] Field of Search ..... 139/123, 122 R, 127 R, 139/116, 124 R, 128, 130.1 E; 64/31; 74/393; 192/67 R, 108

[56] References Cited

UNITED STATES PATENTS

| | | | |
|---|---|---|---|
| 2,050,910 | 8/1936 | Zancan | 192/67 R |
| 2,384,418 | 9/1945 | Edmondson | 192/67 R |
| 3,125,363 | 3/1964 | Kapusta | 192/67 R |
| 3,407,628 | 10/1968 | Eccher | 64/31 |
| 3,539,044 | 11/1970 | Grimstad | 192/67 R |
| 3,610,294 | 10/1971 | Maassen et al. | 139/123 X |
| 3,717,182 | 2/1973 | Sparling | 139/127 R |
| 3,834,500 | 9/1974 | Tsuchiya et al. | 192/67 R |

FOREIGN PATENTS OR APPLICATIONS

| | | | |
|---|---|---|---|
| 1,396,011 | 3/1965 | France | 139/127 R |
| 614,479 | 9/1926 | France | 139/123 |
| 361,027 | 11/1931 | United Kingdom | 192/67 R |
| 1,019,429 | 2/1966 | United Kingdom | 139/123 |

*Primary Examiner*—James Kee Chi

*Attorney, Agent, or Firm*—Walter M. Rodgers; Walter A. Rodgers

[57] ABSTRACT

A shuttleless loom having means for sequentially forming warp sheds driven by main motive means and having rapier means driven by auxiliary motive means for inserting weft threads into the warp sheds in synchronism with the formation of the sheds is provided with disjointable coupling means arranged to couple and uncouple the auxiliary motive means and the main motive means in a manner such that the rapiers may be held out from the shed during shutdown conditions and maintained in a predetermined relationship relative to the auxiliary motive means in such manner that synchronous operation is insured when the loom is again operated.

15 Claims, 4 Drawing Figures

WEFT INSERTING DRIVING MEANS FOR A SHUTTLELESS LOOM

Shuttleless type looms generally are characterized by much faster operation, by considerably less inertia and noise than shuttle type looms. In shuttleless type looms due provision must be made for adequate rapier dwell time required to perform beat-up operations in order to permit insertion and withdrawal of the weft inserting means whether such means be in the form of rapiers or of flexible tapes. Furthermore rapier type shuttleless looms as well as flexible tape type shuttleless looms must be arranged so that the rapiers or tapes are completely withdrawn from the shed during filling pick-out operation. In order properly to perform maintenance and repair operations, it is necessary to operate the loom either by brief increments or by hand. Such operations must be conducted independently of the weft inserting rapier or tape means in order to prevent improperly timed entry of the rapiers into the shed during loom reversing operations which are necessary when filling pick-out operations are performed. Thus it is necessary to uncouple the weft inserting means from the warp shed forming structure, the lay structure and other parts during repair and maintenance. Unless special care is taken, the warp shed forming mechanism and the lay mechanism may be out of synchronism with the weft inserting mechanism following uncoupling of the weft inserting means. If a proper synchronous relationship is reestablished by trial and error considerable time and effort are required.

According to one aspect of this invention, disjointable coupling means is provided whereby the weft inserting means may be withdrawn from the shed and its auxiliary motive means is operably disconnected from the main motive means of the loom only when the weft inserting means and the main motive means together with the warp shed forming means and the lay means are disposed in a predetermined positional relation. The weft inserting means according to this invention is maintained in a predetermined condition until the main motive means is recoupled with the auxiliary motive means for driving the weft inserting means. The coupling means formed according to this invention comprises relatively movable driving and driven elements which move in unison when coupled together and which may be uncoupled only when disposed in a predetermined positional relationship. Thus with the driving and driven coupling elements in uncoupled condition the loom shed forming means and lay means and other parts may be moved independently of the weft inserting means. When recoupled, the driving element is moved into a predetermined positional relation with respect to the driven element and the parts are then recoupled. According to a feature of the invention, the driving and driven elements are rotatable about centers of rotation which are spaced apart so that the speed of rotation of the driven coupling element varies throughout a complete rotation and advantage is taken of this fact to vary the speed of operation and the dwell time of the weft inserting means.

For a better understanding of the invention reference may be had to the following detailed description taken in conjunction with the accompanying drawings in which FIG. 1 is a somewhat schematic perspective view of one end of a shuttleless loom constructed according to the invention;

FIG. 3 is a perspective view of driving mechanism constructed according to the invention and in which

Figure 1:
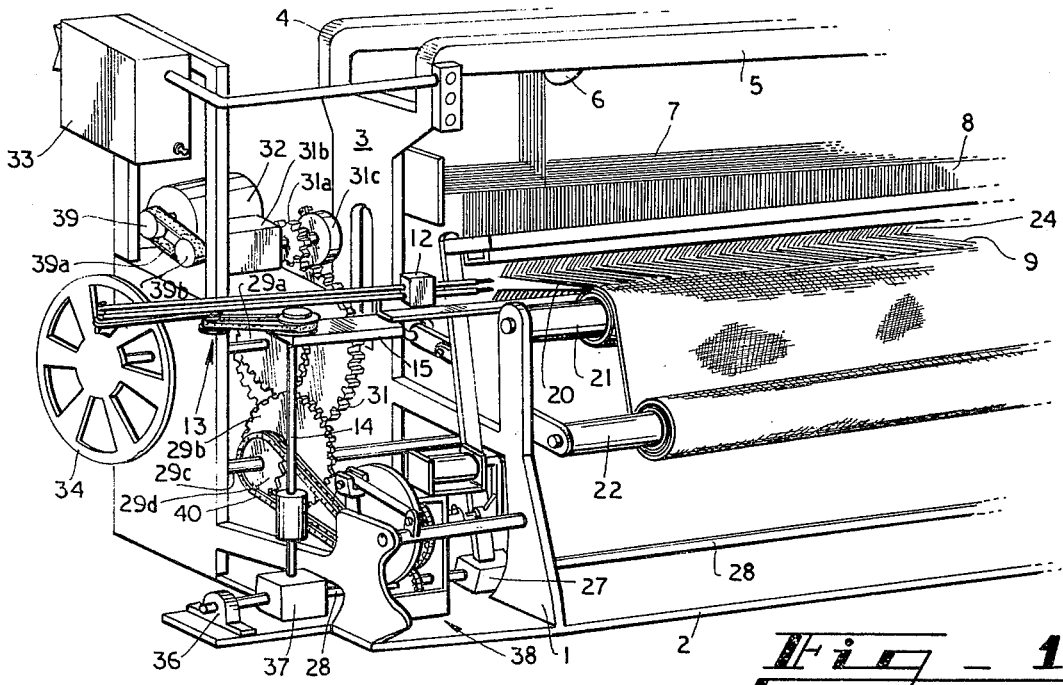

In the drawings the numeral 1 designates a vertically disposed upright frame element which is secured to a horizontally disposed frame element 2. Integral with vertical frame element 1 is a frame element 3 to the upper parts of which horizontally disposed arch frame elements 4 and 5 are secured.

Conventional warp shed forming means comprises a plurality of sheaves 6 which are rotatably supported in known manner by the arches 4 and 5 and which control vertical reciprocatory motion of harness elements 7 and their associated heddles 8 by which the warp threads 9 are controlled in known manner so as to form warp sheds in sequence.

Figure 2:
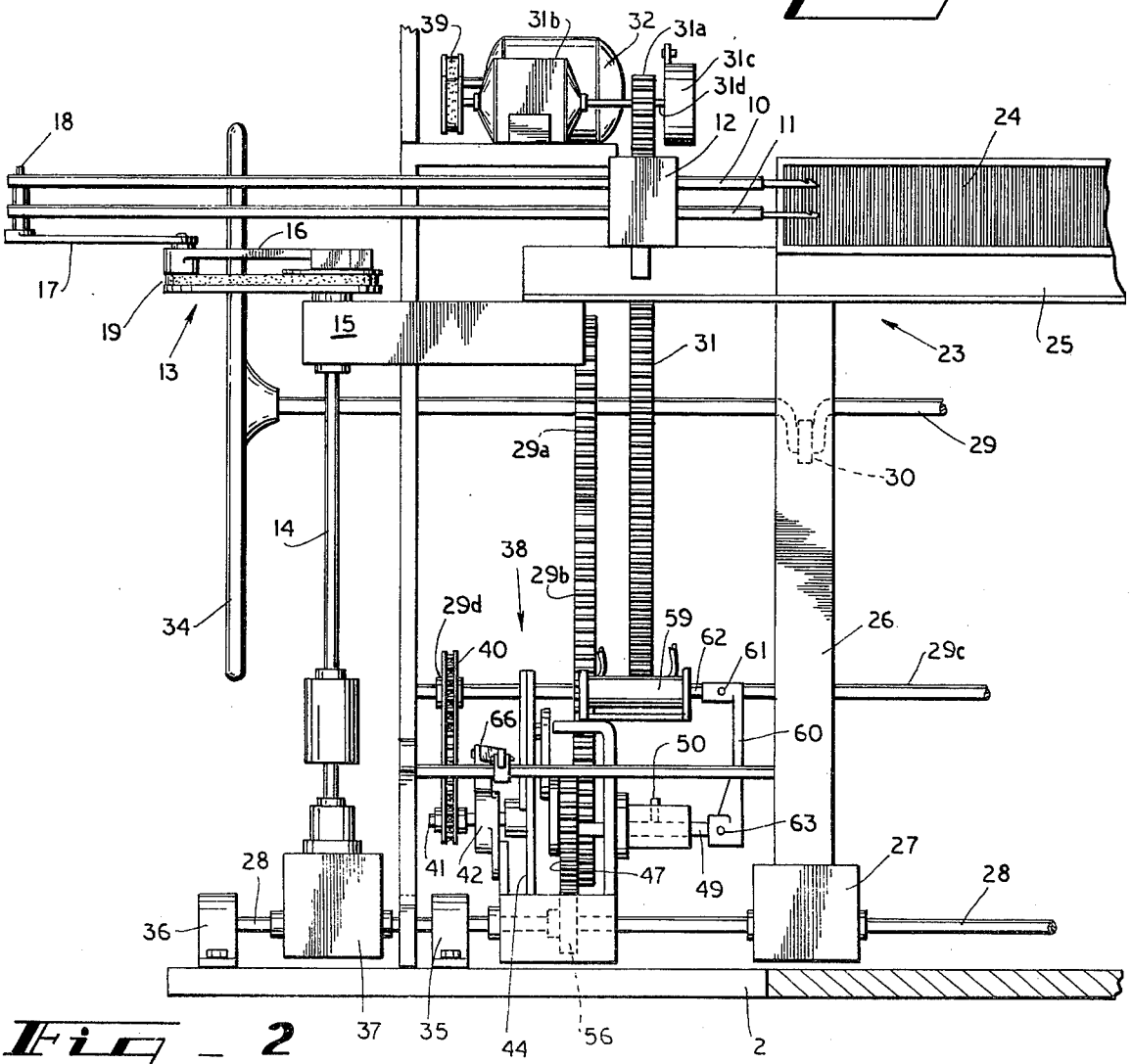
FIG. 2 is a schematic front view of the structure shown in FIG. 1 with certain parts removed for clarity.
Figure 3:
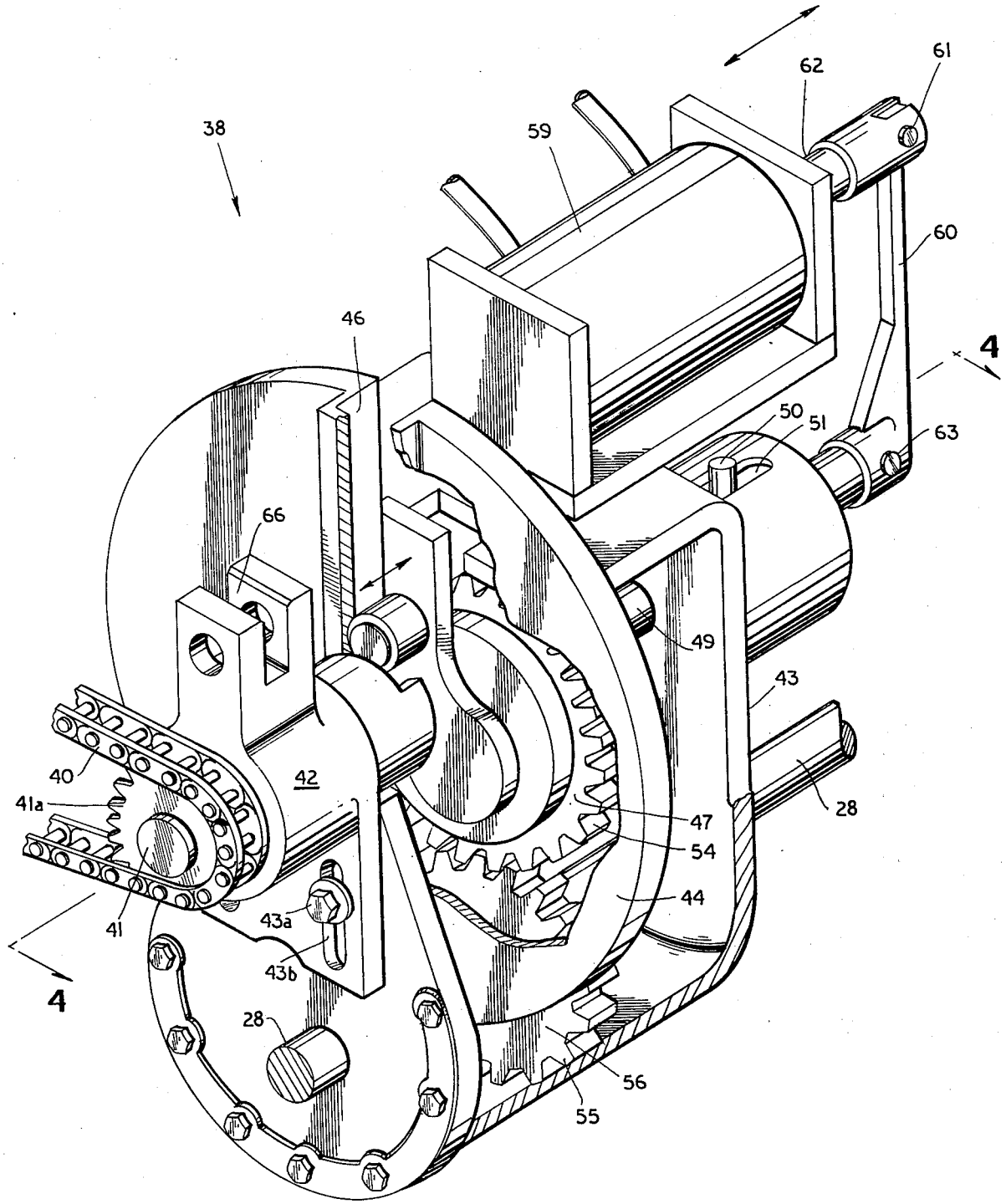

For the purpose of inserting the weft threads into the warp sheds, rapiers 10 and 11 are reciprocably operated into and out of the shed and are disposed on either side of the loom although FIGS. 1 and 2 disclose only one end of a loom. Operating movement of the rapiers 10 and 11 is controlled by guides generally designated at 12.

Operating movement is imparted to rapiers 10 and 11 by weft inserting means generally designated by the numeral 13 which is driven be rotatable shaft 14 journally related with support beam 15 to which a fixed sprocket having exterior teeth is mounted but not clearly shown in the drawings. Fixedly secured to shaft 14 is an arm 16 so that rotation of shaft 14, which extends through the fixed gear mounted on beam 15, imparts rotary movement to arm 16. Pivotally connected at the left hand end of arm 16 is another arm 17 of the same effective length as arm 16 and which in turn at its right hand end as shown in FIG. 2 is pivotally connected at 18 to the rapiers 10 and 11. A chain 19 which cooperates with the teeth of the sprocket fixed on beam 15 imparts rotary movement to a sprocket not shown but which is secured to a pin connected to the righthand end of arm 17. Thus rotation of shaft 14 imparts rotation to arms 16 and 17 and in turn imparts reciprocatory motion to rapiers 10 and 11. For a more complete description of the structure and operation of weft inserting means 13, reference may be had to U.S. Pat. No. 3,335,760 issued Aug. 15, 1967 and captioned "Gripper Loom."

As is well understood, a weft thread connected to the inner end of a rapier such as 10 is fed into the shed approximately half way across and is transferred to a corresponding rapier which enters the shed from the opposite side and which when retracted completes the travel of the weft thread across the shed. Thus sequential formation of sheds followed by synchronous insertion of the two rapiers such as 10 and 11 results in the weaving of a double pile cloth designated in FIG. 1 by the numeral 20 which is cut into two single thickness layers by known means not shown. The lower layer is wound on the horizontal loom roller 21 and the upper layer is wound on roller 22.

While the invention is illustrated in the drawings in conjunction with two rapiers such as 10 and 11, it will be understood that the invention is applicable to apparatus for weaving flat type fabrics as well as double fabrics in which case only one rapier such as 10 or 11 is employed.

In order to beat up the weft threads into the finished body of the cloth 20, lay means generally designated by the numeral 23 is employed. Of course lay means 23 includes reed structure 24 mounted atop beam 25 which in turn is secured to vertical support element 26 which in turn is oscillatable about bearing structure 27 on rotatable shaft 28. Support element 26 is not operably related with shaft 28. A corresponding element such as 26 is not shown but is disposed at the right hand end of the loom as viewed in both figures of the drawing.

For the purpose of imparting oscillatory beat-up motion to the lay means 23 about shaft 28 as a center, a crank shaft 29 is interconnected as schematically indicated at 30 with element 26. Shaft 29 is mounted in bearings (not shown) which are secured in any suitable manner to the frame structure of the loom. Rotary motion is imparted to shaft 29 by any suitable means such as driven gear 31 secured to shaft 29 and which is driven in synchronism with the formation of the warp sheds and with operation of the weft inserting means by motor 32 and gear 31*a*. Motor 32 is secured to the frame structure in any suitable manner and controlled by control means 33 also mounted on the frame of the machine. Motor 32 is coupled by pulley 39, belt 39*a* and pulley 39*b* with clutch 31b. Brake 31*c* is connected with gear 31*a* by shaft 31*d*. Clutch 31*b* and brake 31*c* are of conventional construction. The loom may be operated manually by means of hand wheel 34 secured to crank shaft 29 is desired. Shaft 28 is rotatably supported in bearings 35 and 36 and is coupled with shaft 14 by right angle gear box 37.

The weft inserting means 13 is interrelated with the main motive means by the coupling means generally designated in the drawings by the numeral 38. The main motive means comprises motor 32, gears 31*a* and 31, crank shaft 29 to which gear 31 is secured, gear 29*a*, also secured to shaft 29, gear 29*b* driven be gear 29*a* and which is secured to shaft 29*c*, sprocket 29*d* secured to shaft 29*c*, chain 40, sprocket 41*a* and shaft 41. Shaft 41 is rotatably mounted on bearing structure 42 which in turn is mounted on the housing structure 43 by bolts 43*a*. A driving element 44 is affixed to shaft 41 by means of a key 45 and set screw 45*a* and is provided with a coupling part comprising a driving cavity 46 which is elongated and radially disposed in the circular driving element 44.

A driven element 47 is mounted on bearing structure 48 affixed as by a pressed fit to stub shaft 49. Shaft 49 is secured against rotation by means of a pin 50 which is secured to the shaft 49 and which rides in a fixed slot 51. Driven element 47 is rotatable about shaft 49 by virtue of bearings 48.

Figure 4:
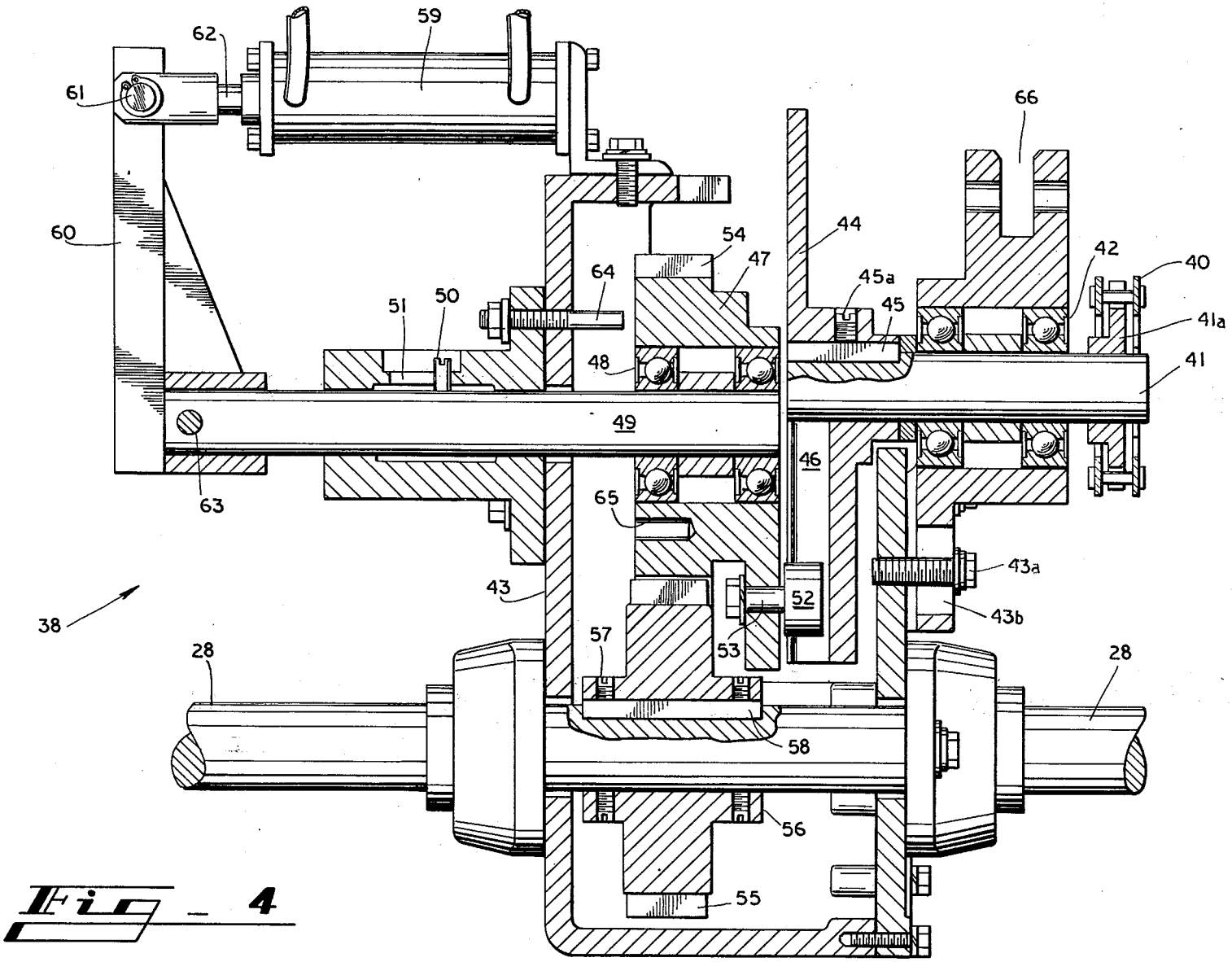
FIG. 4 is a cross-sectional view taken along the line designated 4—4 in FIG. 3.

For the purpose of operably relating the driving element 44 with the driven element 47, a coupling part comprising a driving roller 52 is rotatably mounted on bolt 53 on driven element 47 and when the parts are in coupled condition as shown in FIG. 4, driving roller 52 is disposed within the elongated radially disposed driving cavity 46. The width of cavity 46 is such that the cavity receives roller 52 without substantial lost motion in a direction transverse to the cavity. With the parts in the positions shown in FIG. 4, rotation of driving element 44 imparts rotation to driven element 47 via coupling parts 52 and 46. Since driven element 47 is provided with peripheral teeth 54 which are enmeshed with the teeth 55 of pinion 56 secured by set screws 57 and locking key 58 to shaft 28, rotation of driven element 47 imparts rotary motion to pinion 56 which in turn rotates shaft 28 and through gear box 37 imparts rotary motion to drive shaft 14 thereby to cause the weft inserting mechanism 13 to operate the rapiers 10 and 11 into and out of the sheds as they are formed.

For the purpose of uncoupling the coupled relationship of the driving element and the driven element as shown in FIG. 4, and in accordance with a feature of this invention, the driven element is moved in an axial direction away from the driving element 44. In order to perform such movement, a fluid motor having a cylinder and piston designated by the numeral 59 is provided and is interconnected with shaft 49 by means of a crosshead 60 interconnected by pin 61 with piston rod 62. Crosshead 60 is interconnected with shaft 49 by means of pin 63. The above described pneumatic mechanism for imparting sidewise movement to driven element 47 is herein referred to as control means.

Since it is vital that synchronous conditions be readily reestablished between the weft inserting means and its auxiliary motive means relative to the main motive means and the shed forming and lay operating means of the loom, means are provided according to this invention to insure that the parts may become uncoupled and recoupled only when disposed in a predetermined relationship. Thus in accordance with one facet of this invention, uncoupling movement toward the left of driven element 47 as viewed in FIG. 4 is prevented by holding element 64 which is fixedly mounted to the housing structure 43 as best shown in FIG. 4. Arranged to receive the holding element 64 is a holding recess 65 formed in the body portion of driven element 54. With the parts shown in the positions which they occupy in FIG. 4, it is not possible to uncouple the driven element from the driving element. With the control means arranged to exert a force toward the left by which driven element 47 is moved into engagement with the holding element 64, rotation of the driving element 44 causes the driving element 44 and the driven element 47 to move in unison until such time as the holding recess 65 comes into coincidence with the holding element 64. When this particular predetermined positional relationship occurs, a force to the left as viewed in FIG. 4 exerted by the control means causes the driven element 47 to move toward the left in such manner that the holding recess 65 receives the holding element 64, This movement of driven element 47 does not cause its teeth 54 to disengage teeth 55 of pinion 56. When this operation is completed, the auxiliary motive means wich imparts operating movement to the rapiers 10 and 11 is effectively locked in a predetermined position. Of course the driving element 44 together with the main motive means including shaft 41 and the various shed forming parts and lay operating parts of the loom may be moved independently of the weft inserting means. During this operation, the rapiers 10 and 11 are withdrawn from the shed and maintenance and repair operations may be easily performed with the rapiers removed and out of obstructing positions.

When it is desired to recouple the weft inserting auxiliary motive means with the main motive means, it is simply necessary to energize the motor 32 thus to cause shaft 41 and driving element 47 to rotate. At the point in the rotation of driving element 44 at which driving cavity 46 comes into coincidence with driving roller 52, the driven element 47 due to pressure exerted thereon by control means including fluid motor 59 and parts associated therewith imparts sidewise motion to the right as viewed in FIG. 4 to the driven element 47 and forces the driven roller 52 into the driving cavity 46. This operation causes the holding recess 65 to move out of cooperative engagement with the holding element 64 so that the weft inserting auxiliary motive means is then in driving coupled relationship with the main motive means and the loom is in condition for synchronous operation once again.

Since the speed of insertion and withdrawal of the rapiers must be properly controlled and since adequate dwell times during each operating cycle must be provided, such controlled movement of the rapiers is considerably facilitated by the fact that the center line of the drive shaft 41 is spaced from the center line of rotation of driven element 47 as is apparent in FIG. 4. Thus since the driving cavity 46 is radially disposed and elongated, rotation of shaft 41 and of driving element 44 causes the driving roller 52 to move radially inwardly and outwardly relative to shaft 41 as the driven element 47 is rotated. Of course this in and out movement of the driven roller 52 varies continuously the effective radius between the center of rotation of roller 52 and the center of rotation of the drive shaft 41 so that the speed of rotation as well as the dwell time of the weft inserting means is constantly varied due to variations in the velocity of rotation of the driven element 47.

According to another feature of the invention the tension of driving chain 40 may be adjusted due to the fact that the coupling means including driving element 44 and driven element 47 and parts associated therewith are movable with the housing 43 which in turn is pivotally mounted on shaft 28. Thus adjustment of turn buckle 66 effectively swings and the housing 43 and parts associated therewith back and forth about the shaft 28 as a pivot. By this means the tension of chain 40 may readily be adjusted.

The embodiments of the invention in which an exclusive property or privilege is claimed are defined as follows:

1. A loom comprising means for sequentially forming warp sheds, main motive means interconnected with said means for forming warp sheds for imparting operating movement thereto, weft inserting means operable in synchronism with said means for sequentially forming warp sheds for inserting weft threads therein, auxiliary motive means interconnected with said weft inserting means for imparting operating movement thereto, disjointable coupling means having a rotatable driving element coupled with said main motive means and a rotatable driven element coupled with said weft inserting means, said driving and driven elements being relatively movable axially from coupled to uncoupled relationship and being relatively rotatable independently of each other when uncoupled and being rotatable in unison only when disposed in predetermined angular and axial positions relative to each other, and a holding element arranged to engage one of said elements so as to prevent relative axial movement of said elements in a direction tending to uncouple said elements except when said elements are disposed in a predetermined angular relation to each other.

2. A loom according to claim 1 wherein one of said elements includes a driving cavity and the other of said elements includes a driving roller arranged to be inserted into said cavity to establish a coupled operating relation therebetween.

3. A loom according to claim 1 wherein said driving element includes a driving cavity and said driven element includes a driving roller.

4. A loom according to claim 3 wherein said driving and driven elements are relatively movable to cause said driving roller to enter said driving cavity only when said driving and said driven elements are disposed in a predetermined positional relation to each other.

5. A loom according to claim 3 wherein said driving and said driven elements are rotatable and wherein said driving cavity is elongated and radially disposed in said driving element so as to accommodate movement of said roller in a direction radially of said driving element.

6. A loom according to claim 5 wherein said cavity is of a width sufficient bodily to receive said roller without substantial lost motion in a direction transverse to said cavity.

7. A loom according to claim 1 wherein said auxiliary motive means includes a part which is coupled with said driven element irrespective of the relative positions of said driving and driven elements.

8. A loom according to claim 1 wherein control means is interconnected with said driven element and operable to impart movement thereto relative to said driving element only when said driving and said driven elements are disposed in a predetermined positional relation to each other.

9. A loom according to claim 8 wherein a holding recess is formed in said driven element for receiving said holding element when said elements occupy predetermined positions.

10. A loom according to claim 9 wherein said holding element is effective to secure said auxiliary motive means in an inactive predetermined condition when said holding element is disposed in said holding recess.

11. A loom according to claim 1 wherein said weft inserting means comprises rapier means.

12. A loom according to claim 7 wherein said part comprises a rotatable pinion mounted on a shaft which in turn is mounted on fixed bearings.

13. A loom according to claim 12 wherein a housing is supported on said shaft and pivotally movable thereabout.

14. A loom according to claim 13 wherein said main motive means includes an endless driving element arranged to rotate a shaft rotatably mounted in said housing and wherein pivotal movement of said housing about said shaft varies the tension of said endless element.

15. A loom comprising means for sequentially forming warp sheds, main motive means interconnected with said means for forming warp sheds for imparting operating movement thereto, weft inserting means operable in synchronism with said means for sequentially forming warp sheds for inserting weft threads therein, auxiliary motive means interconnected with said weft inserting means for imparting operating movement thereto, and disjointable coupling means having a rotatable driving element coupled with said main motive means and a rotatable driven element coupled with said weft inserting means, the axes of rotation of said driving and of said driven elements being substantially parallel and spaced apart, said driving and driven elements being relatively movable when uncoupled and being movable in unison only when disposed in predetermined angular and axial positions relative to each other.

* * * * *